US012259224B1

(12) United States Patent
Petrangelo

(10) Patent No.: US 12,259,224 B1
(45) Date of Patent: Mar. 25, 2025

(54) AMMUNITION RELOADING PRESS PRIMER REAMER

(71) Applicant: Vincent Russell Petrangelo, San Juan Capistrano, CA (US)

(72) Inventor: Vincent Russell Petrangelo, San Juan Capistrano, CA (US)

( * ) Notice: Subject to any disclaimer, the term of this patent is extended or adjusted under 35 U.S.C. 154(b) by 0 days.

(21) Appl. No.: 17/362,528

(22) Filed: Jun. 29, 2021

Related U.S. Application Data

(60) Provisional application No. 63/046,052, filed on Jun. 30, 2020.

(51) Int. Cl.
*F42B 33/10* (2006.01)
*F42B 33/04* (2006.01)
*F42B 33/02* (2006.01)

(52) U.S. Cl.
CPC ..... *F42B 33/10* (2013.01); *F42B 33/04* (2013.01); *F42B 33/025* (2013.01)

(58) Field of Classification Search
CPC ..... F42B 33/00; F42B 33/02; F42B 33/04; F42B 33/002; F42B 33/004; F42B 33/025; F42B 33/10
USPC ..... 86/36, 37
See application file for complete search history.

(56) References Cited

U.S. PATENT DOCUMENTS 2,744,307 A * 5/1956 Smiley ..... B23B 5/168 29/57
5,050,475 A * 9/1991 Kolmer ..... F42B 33/10 86/24
5,649,464 A * 7/1997 Gracey ..... F42B 33/10 408/72 R
6,397,718 B2 * 6/2002 Jamison ..... B23B 29/248 86/24
9,970,741 B1 * 5/2018 Eldredge ..... B23B 5/00

* cited by examiner

*Primary Examiner* — James S Bergin
(74) *Attorney, Agent, or Firm* — Plager Schack LLP; Mark H. Plager, Esq.; Michael J. O'Brien, Esq.

(57) ABSTRACT

An ammunition reloading press primer reamer is configured to remove a primer crimp from a casing and straightening a pocket in the casing. The ammunition reloading press primer reamer has a spring arranged around a base body and arranged against a main body. A shuttle is inserted into the main body with a thrust bearing and held in place with a drilling cable. A tip is inserted into the shuttle and partially surrounded by a roller bearing. A press has a connecting rod attached to the adjustment bolt and joined to a crankshaft with a crankshaft cam. A casing holder is attached to the press and configured to hold a casing. A tool holding arm is attached to the press and further comprising a face plate attached with a plurality of screws. As the crankshaft is pulled down, the tip spins and cuts a beveled ream into the casing.

5 Claims, 4 Drawing Sheets

AMMUNITION RELOADING PRESS PRIMER REAMER

RELATED APPLICATION

This application claims priority to provisional patent application U.S. Ser. No. 63/046,052 filed on Jun. 30, 2020, the entire contents of which is herein incorporated by reference.

BACKGROUND

The embodiments herein relate generally to firearms and ammunition accessories.

During the reloading of small arms ammunition process there is what's called a crimp on primers. When the primer is removed the crimp also need to be removed. That is achieved by either swaging process or cutting out the crimp. The swaging process is inconsistent and often not very effective. Embodiments of the disclosed invention solve this problem.

SUMMARY

An ammunition reloading press primer reamer is configured to remove a primer crimp from a casing and straightening a pocket in the casing. The ammunition reloading press primer reamer has a spring arranged around a base body and arranged against a main body. A shuttle is inserted into the main body with a thrust bearing and held in place with a drilling cable. A tip is inserted into the shuttle and partially surrounded by a roller bearing. A press has a connecting rod attached to the adjustment bolt and joined to a crankshaft with a crankshaft cam. A casing holder is attached to the press and configured to hold a casing. A tool holding arm is attached to the press and further comprising a face plate attached with a plurality of screws. As the crankshaft is pulled down, the tip spins and cuts a beveled ream into the casing.

In some embodiments, an adjustment bolt can be threaded onto the base body with a lock nut. A retaining pin can join the base body to a slot the main body. The base body can laterally slide within the main body.

A housing back houses the main body and is joined to a housing front with a plurality of housing fasteners. An electric microswitch can be attached to the housing front with a plurality of screws.

A decapping die can be configured to remove a primer from a primer cavity in the casing. A vacuum attachment can evacuate the chips during cutting and cools the tip. Engaging the crankshaft can move the press one position and inserts the casing into the casing holder.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
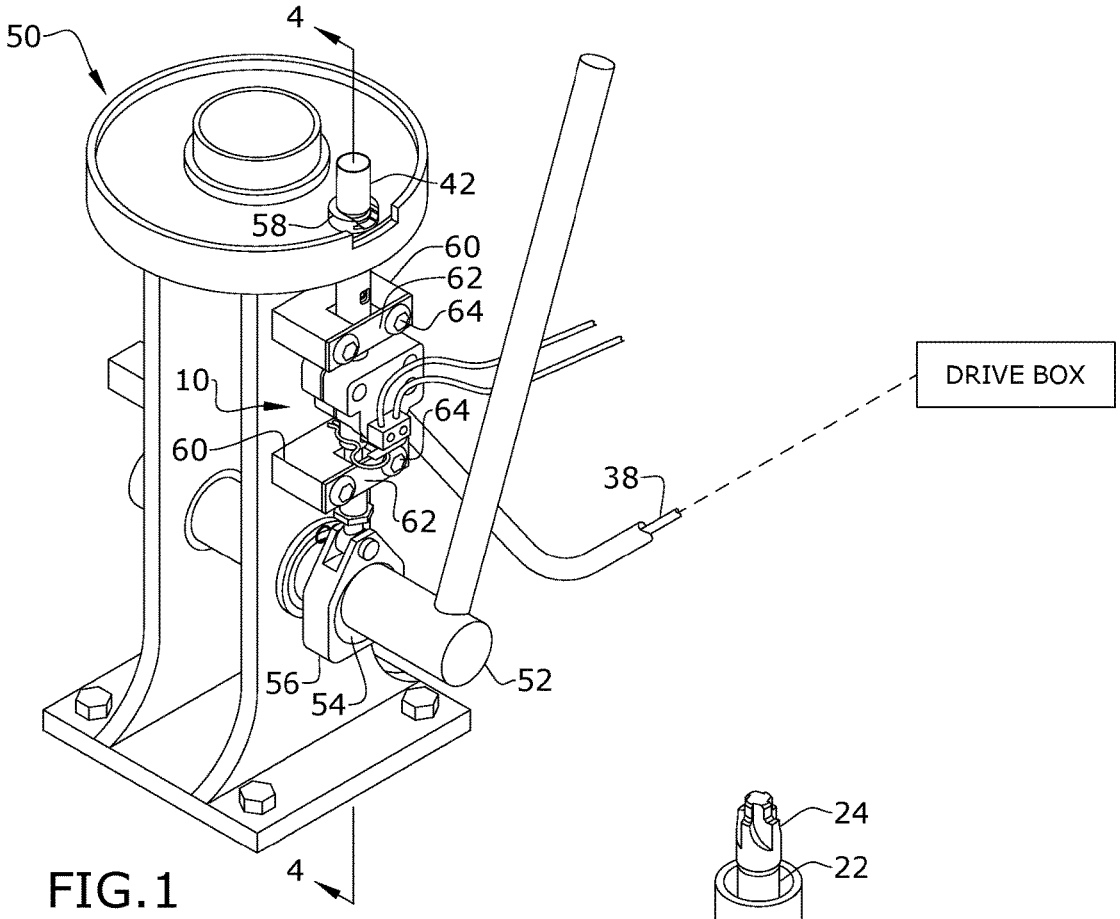
FIG. 1 shows a perspective view of one embodiment of the present invention, shown in use.
Figure 2:
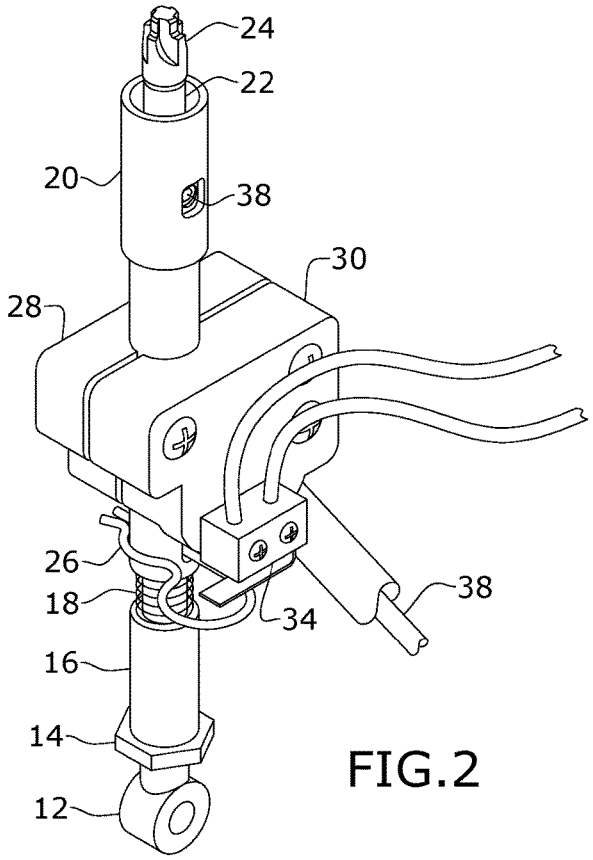
FIG. 2 shows a perspective view of one embodiment of the present invention.
Figure 3:
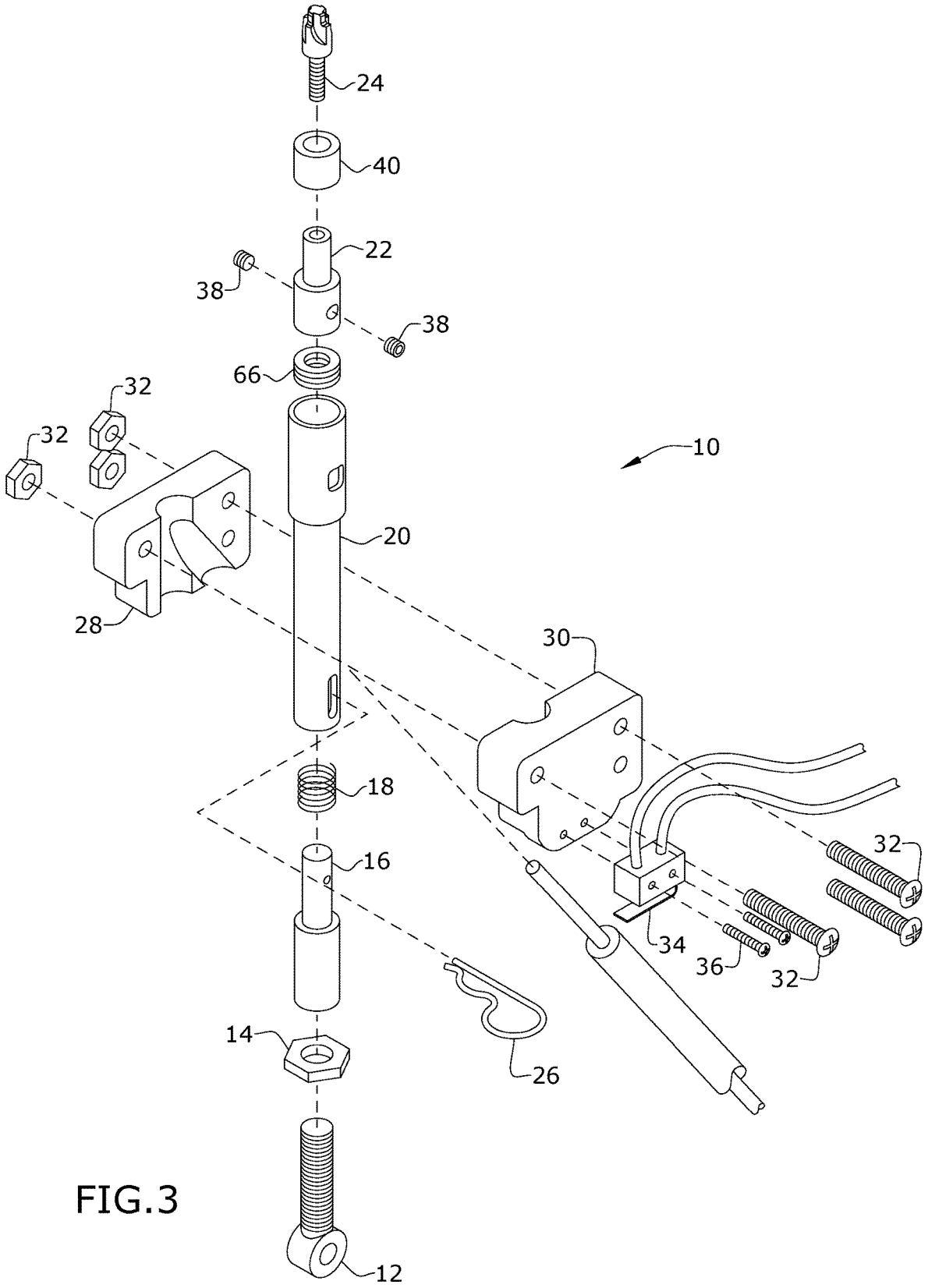
FIG. 3 shows an exploded view of one embodiment of the present invention.
Figure 4:
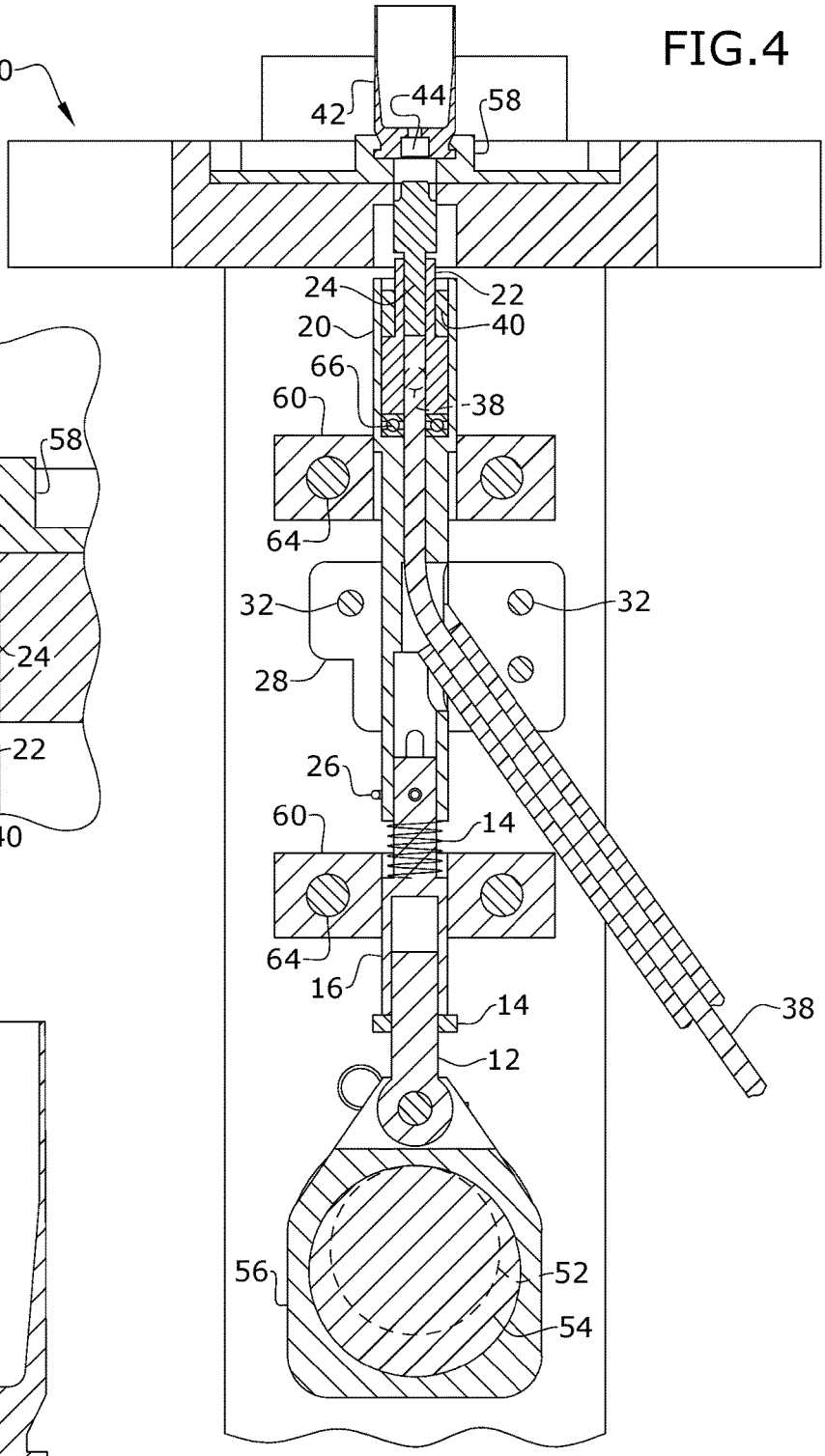
FIG. 4 shows a section view of one embodiment of the present invention taken along line 4-4 in FIG. 1.
Figure 5:
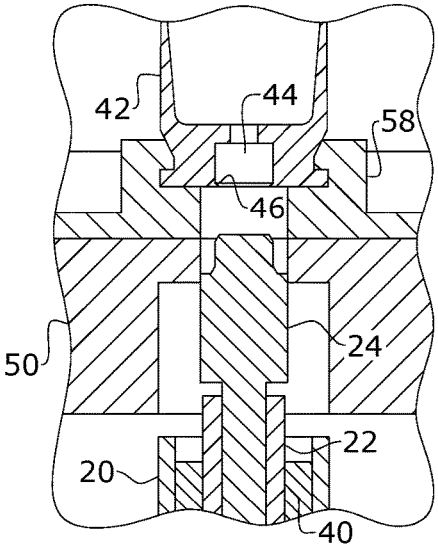
FIG. 5 shows an enlarged detail view of one embodiment of the present invention.
Figure 6:
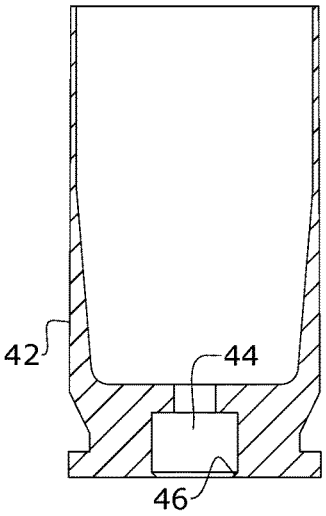
FIG. 6 shows a section view of one embodiment of a cartridge casing of the present invention prior to the tooling process.
Figure 7:
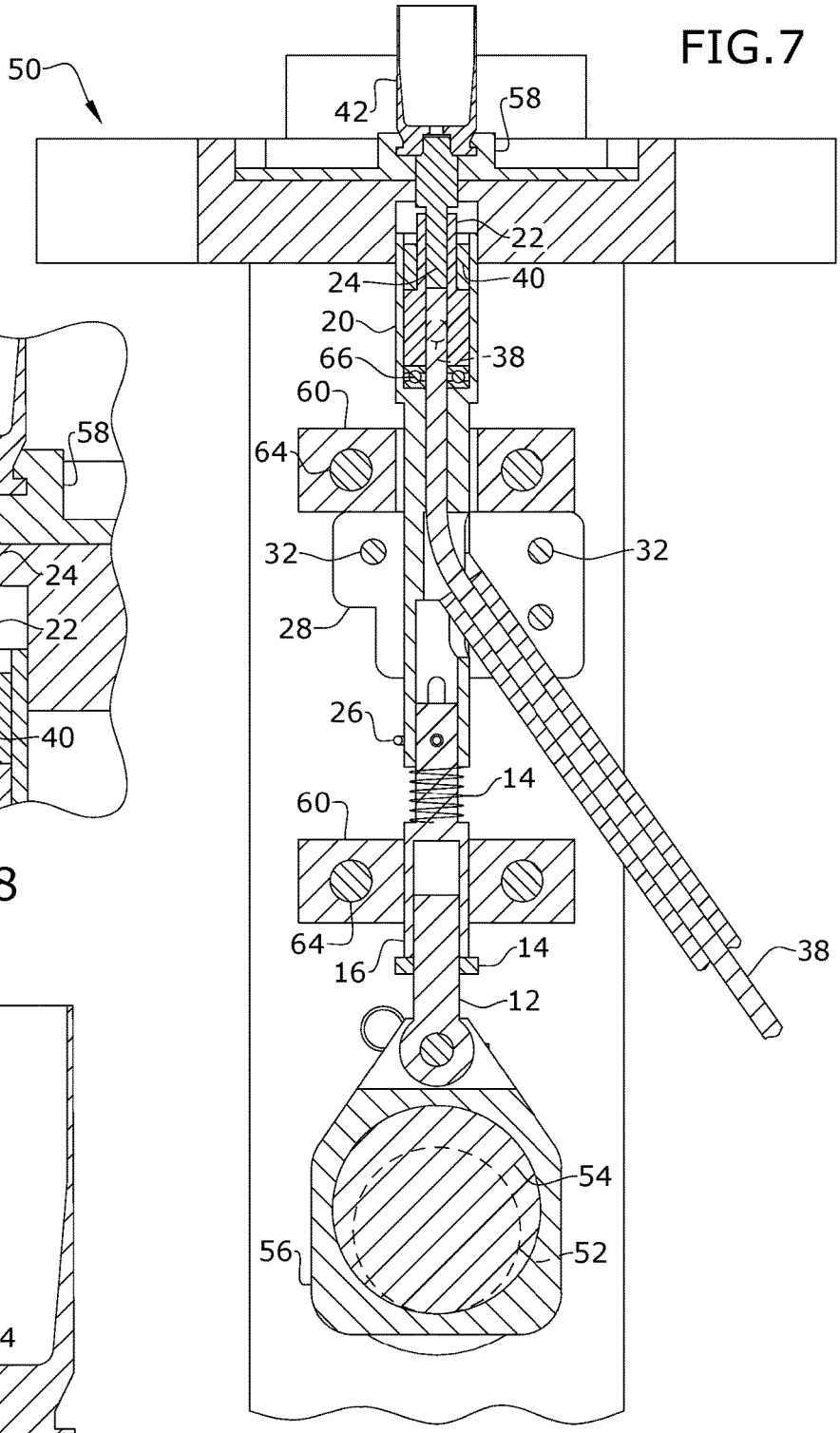
FIG. 7 shows a section view of one embodiment of the present invention.
Figure 8:
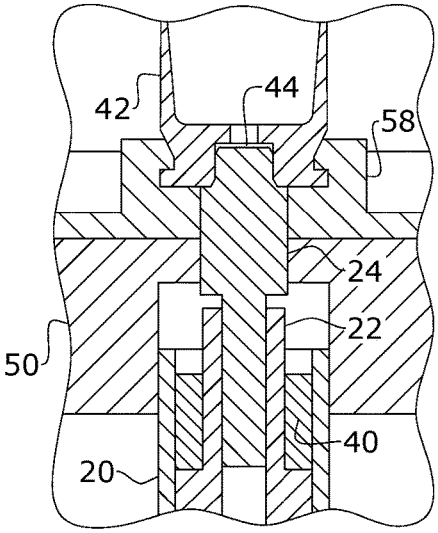
FIG. 8 shows an enlarged detail view of one embodiment of the present invention.
Figure 9:
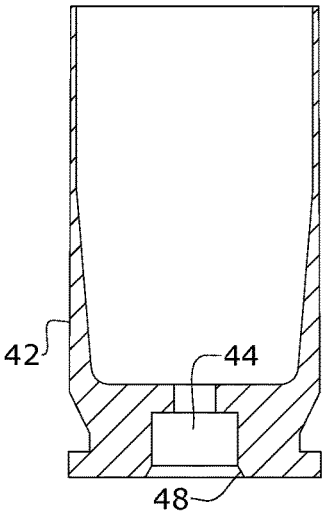
FIG. 9 shows a section view of one embodiment of the present invention.

By way of example, and referring to FIGS. 1-9, one embodiment of an ammunition reloading press primer reamer 10 further comprises an adjustment bolt 12 joined to a base body 16 with a lock nut 14. A spring 18, partially covers the base body 16 and is housed within the main body 20. A retaining pin 26 connects the base body to the main body such that the base body can slide laterally within the main body.

A shuttle 22, is partially housed within the main body 20 with a thrust bearing 66. A drilling cable 38 is arranged through the shuttle 22. A tip 24 is joined to the shuttle 22 with a roller bearing 40.

A housing further comprises a housing back 28 joined to a housing front 30 with a plurality of housing fasteners 32. An electric microswitch 34 is joined to the housing front 30 with a plurality of screws 36. A drilling cable 38 is arranged through the main body 20 and is electrically coupled to a drive box.

A press 50 further comprises a crankshaft 52 arranged through a connecting rod 56 with a crankshaft cam 54. The press 50 further comprises a casing holder 58. The casing holder 58 holds a cartridge case 42. The cartridge case 42 further comprises a primer cavity 44 and a crimped edge 46.

A tool holding arm 60 is attached to the press 50 and is attached to a cover plate 62 with screws 64. A decapping die can be configured to remove the primer 46 from a primer cavity 44 in the casing 42. A vacuum attachment can evacuate the chips during cutting and cools the tip. Engaging the crankshaft 52 can move the press one position and inserts the casing 42 into the casing holder 58.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. An ammunition reloading press primer reamer, configured to remove a primer crimp from a casing and straightening a pocket in the casing; the ammunition reloading press primer reamer comprising:

a spring, arranged around a base body, and arranged against a main body;

a shuttle, inserted into the main body with a thrust bearing and held in place with a drilling cable;

a tip, inserted into the shuttle and partially surrounded by a roller bearing;

a press further comprising:

a connecting rod attached to an adjustment bolt, and joined to a crankshaft with a crankshaft cam;

a casing holder, attached to the press and configured to hold a casing;

a tool holding arm, attached to the press and further comprising a face plate attached with a plurality of screws; wherein the tool holding arm holds the base body wherein as the crankshaft is pulled down, the drilling cable spins and thus the shuttle and the tip spins and cuts a beveled ream into the casing.

2. The ammunition reloading press primer reamer of claim 1, where the adjustment bolt is threaded onto the base body with a lock nut.

3. The ammunition reloading press primer reamer of claim 2, further comprising a retaining pin joining the base body to a slot in the main body; wherein the base body can laterally slide within the main body.

4. The ammunition reloading press primer reamer of claim 3, further comprising a housing back, housing the main body and joined to a housing front with a plurality of housing fasteners.

5. The ammunition reloading press primer reamer of claim 4, further comprising an electric microswitch, attached to the housing front with a plurality of screws.

* * * * *